US011193195B2

(12) United States Patent
Takeuchi et al.

(10) Patent No.: US 11,193,195 B2
(45) Date of Patent: Dec. 7, 2021

(54) COMPONENT FOR HOT-DIP METAL PLATING BATH

(71) Applicants: TOCALO CO., LTD., Hyogo (JP); DAIDO STEEL CO., LTD., Aichi (JP); DAIDO CASTINGS CO., LTD., Aichi (JP)

(72) Inventors: Junichi Takeuchi, Hyogo (JP); Masaya Nagai, Chiba (JP); Shinichi Kubo, Chiba (JP); Masashi Nagaya, Aichi (JP); Yoshinori Sumi, Aichi (JP); Yoshihiko Koyanagi, Aichi (JP); Hiroyuki Takabayashi, Aichi (JP); Yasuhiro Takenaka, Aichi (JP)

(73) Assignees: TOCALO CO., LTD., Hyogo (JP); DAIDO STEEL CO., LTD., Aichi (JP); DAIDO CASTINGS CO., LTD., Aichi (JP)

( * ) Notice: Subject to any disclaimer, the term of this patent is extended or adjusted under 35 U.S.C. 154(b) by 69 days.

(21) Appl. No.: 16/616,323

(22) PCT Filed: May 17, 2018

(86) PCT No.: PCT/JP2018/019044
§ 371 (c)(1),
(2) Date: Nov. 22, 2019

(87) PCT Pub. No.: WO2018/216589
PCT Pub. Date: Nov. 29, 2018

(65) Prior Publication Data

US 2020/0087770 A1 Mar. 19, 2020

(30) Foreign Application Priority Data

May 24, 2017 (JP) ..... JP2017-102832

(51) Int. Cl.
*C23C 4/067* (2016.01)
*C22C 38/00* (2006.01)
(Continued)

(52) U.S. Cl.
CPC ..... *C23C 4/11* (2016.01); *C22C 38/001* (2013.01); *C22C 38/002* (2013.01); *C22C 38/02* (2013.01);
(Continued)

(58) Field of Classification Search
CPC ..... C23C 4/067; C23C 4/10; C22C 38/001; C22C 38/002; C22C 38/02; C22C 38/04;
(Continued)

(56) References Cited

U.S. PATENT DOCUMENTS 6,129,994 A * 10/2000 Harada ..... C23C 4/02 428/627
2007/0215252 A1* 9/2007 Noda ..... C22C 38/24 148/325

FOREIGN PATENT DOCUMENTS

JP 55-079857 A 6/1980
JP 62047460 A 3/1987
(Continued)

OTHER PUBLICATIONS

Sanae, et al., WO 2015/173843 A1 machine translation, Apr. 20, 2017, entire machine translation (Year: 2017).*
(Continued)

*Primary Examiner* — Humera N. Sheikh
*Assistant Examiner* — Katherine A Christy
(74) *Attorney, Agent, or Firm* — Millen, White, Zelano & Branigan, PC; Ryan Pool

(57) ABSTRACT

A component for a hot-dip metal plating bath includes a base material and a thermal spray coating disposed to cover a surface of the base material. The base material includes
(Continued)

ferritic stainless steel that contains: C: 0.10% to 0.50% by mass; Si: 0.01% to 4.00% by mass; Mn: 0.10% by mass to 3.00% by mass; Cr: 15.0% to 30.0% by mass; a total of Nb, V, Ti, and Ta: 0.9% by mass to 5.0% by mass; and a balance of Fe and unavoidable impurities. The ferritic stainless steel includes a microstructure that includes a ferrite phase as a main phase and a crystallized carbide, an area fraction of a Nb carbide, a Ti carbide, a V carbide, a Ta carbide, and a composite carbide thereof to the crystallized carbide of 30% or more. The hot-dip metal plating bath contains 50% by mass or more of Al.

15 Claims, 4 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/30*** | (2006.01) |
| ***C22C 38/32*** | (2006.01) |
| ***C22C 38/48*** | (2006.01) |
| ***C23C 4/10*** | (2016.01) |
| ***C22C 38/08*** | (2006.01) |
| ***C22C 38/10*** | (2006.01) |
| ***C22C 38/34*** | (2006.01) |
| ***C22C 38/38*** | (2006.01) |
| ***C22C 38/18*** | (2006.01) |
| ***C23C 4/11*** | (2016.01) |

(52) U.S. Cl.
CPC ..... *C22C 38/04* (2013.01); *C22C 38/06* (2013.01); *C22C 38/08* (2013.01); *C22C 38/10* (2013.01); *C22C 38/18* (2013.01); *C22C 38/20* (2013.01); *C22C 38/22* (2013.01); *C22C 38/24* (2013.01); *C22C 38/28* (2013.01); *C22C 38/30* (2013.01); *C22C 38/32* (2013.01); *C22C 38/34* (2013.01); *C22C 38/38* (2013.01); *C22C 38/48* (2013.01); *C23C 4/067* (2016.01); *C23C 4/10* (2013.01)

(58) Field of Classification Search
CPC ..... C22C 38/06; C22C 38/08; C22C 38/10; C22C 38/18; C22C 38/20; C22C 38/22; C22C 38/24; C22C 38/28; C22C 38/30; C22C 38/32; C22C 38/34; C22C 38/38; C22C 38/48
USPC ..... 428/472
See application file for complete search history.

(56) References Cited

FOREIGN PATENT DOCUMENTS

| | | | |
|---|---|---|---|
| JP | 3162551 | A2 | 7/1991 |
| JP | 06-228711 | A | 8/1994 |
| JP | 2000-104139 | A | 4/2000 |
| JP | 2003138350 | A | 5/2003 |
| WO | 15173843 | A1 | 11/2015 |

OTHER PUBLICATIONS

International Search report WO2018JP19044 dated Aug. 14, 2018 (pp. 1-4).

* cited by examiner

COMPONENT FOR HOT-DIP METAL PLATING BATH

TECHNICAL FIELD

The present invention relates to a component for a hot-dip metal plating bath. More specifically, the present invention relates to a component for a hot-dip metal plating bath that is used for a hot-dip Zn—Al plating bath containing 50% by mass or more of Al or a hot-dip Al plating bath.

BACKGROUND ART

Components for a bath in a hot-dip zinc plating facility, such as a container, a transportation pump, a sink roll, a support roll, and an agitation jig, are subjected to flow wear and corrosive attack by molten zinc, so that the components are desirably formed of a material having large resistance to molten zinc.

As such a material, for example, Patent Literature 1 proposes an alloy that contains, in % by weight, C: 0.1% or less, Si: 1.5% to 5.0%, Mn: 2.5% to 5.5%, Cr: 10% to 15%, and Ni: 0.5% or less, as well as one or two or more elements selected from the group consisting of Mo: 2.0% or less, Nb: 2.0% or less, W: 2.0% or less, Ti: 2.0% or less, and B: 1.0% or less, with a balance being substantially Fe, and that has excellent molten zinc corrosion resistance.

Patent Literature 2 proposes, as an alloy having large resistance to corrosion by molten zinc, an alloy that contains C: 0.40% or less, Si: 1.50% to 3.50%, Mn: 20% or less, and Cr: 3.0% to 20.0%, and one or two or more elements selected from Ni: 5.0% or less, Mo: 5.0% or less, W: 5.0% or less, Nb: 2.0% or less, Ti: 1.0% or less, V: 1.0% or less, or Al: 1.0% or less, with a balance substantially formed of Fe, and that has excellent molten zinc corrosion resistance.

On the other hand, a new plating technique recently developed and put to practical use is a treatment method for immersing a component or a member in an Al-containing hot-dip Al—Zn alloy plating bath to perform Al—Zn alloy plating. There has been, however, a problem of causing significant erosion to significantly shorten a life of a bathtub when an alloy that has been conventionally used as a bathtub material for a hot-dip Zn plating bath (bath temperature: 410° C. to 500° C.) is used as the bathtub material for a hot-dip Al—Zn bath without any change. Particularly, an increase in Al content has shortened the life of the bathtub in the hot-dip Al—Zn alloy plating bath.

In order to solve this problem, Patent Literature 3 proposes, as a cast metal that is used as the component for a hot-dip Al—Zn alloy plating bath containing 3% by weight to 10% by weight of Al, a cast iron metal for a hot-dip Al—Zn plating bathtub that has a composition of C: 2.0% to 4.0%, Si: 2.0% to 5.0%, Mn: 0.1% to 3.0%, and Cr: 3.0% to 25.0%, with a balance formed of Fe and unavoidable impurities, and that has excellent erosion resistance.

CITATION LIST

Patent Literatures

Patent Literature 1: Japanese Unexamined Patent Publication No. H6-228711

Patent Literature 2: Japanese Unexamined Patent Publication No. S55-79857

Patent Literature 3: Japanese Unexamined Patent Publication No. 2000-104139

SUMMARY OF INVENTION

Technical Problem

In the hot-dip Al—Zn plating bath, however, Fe eluted from a steel strip or an in-bath component sometimes reacts with Al or Zn in the plating bath to generate, in the plating bath, a particulate product (mainly particles of, for example, a Fe—Al alloy) called dross. Dross generated on (attached to) surfaces of, for example, a sink roll and a support roll as components for a hot-dip metal plating bath has sometimes caused a defect such as a flaw on the steel strip during conveyance of the steel strip by the rolls. This problem is particularly likely to occur in an Al—Zn plating bath having an Al content of 50% by mass or more and an Al plating bath, and has been an issue to be solved for a long period.

The inventors of the present invention have earnestly studied to avoid such a problem and completed the present invention based on a new technical idea.

Solution to Problem (1) A component for a hot-dip metal plating bath according to the present invention includes a base material and a thermal spray coating disposed to cover at least part of a surface of the base material, the base material being formed of ferritic stainless steel that contains:

C: 0.10% by mass or more and 0.50% by mass or less;

Si: 0.01% by mass or more and 4.00% by mass or less;

Mn: 0.10% by mass or more and 3.00% by mass or less;

Cr: 15.0% by mass or more and 30.0% by mass or less;

a total of Nb, V, Ti, and Ta: 0.9% by mass or more and 5.0% by mass or less; and a balance of Fe and unavoidable impurities, the ferritic stainless steel having:

a microstructure that includes a ferrite phase as a main phase and a crystallized carbide; and an area fraction of a Nb carbide, a Ti carbide, a V carbide, a Ta carbide, and a composite carbide thereof to the crystallized carbide of 30% or more, the thermal spray coating being formed of a ceramic coating and/or a cermet coating, and the component being used for a hot-dip Zn—Al plating bath containing 50% by mass or more of Al or a hot-dip Al plating bath.

The component for a hot-dip metal plating bath includes a base material formed of ferritic stainless steel having a specific composition and includes a thermal spray coating formed of a ceramic coating and/or a cermet coating disposed to cover at least part of a surface of the base material.

As described later, the ferritic stainless steel independently exhibits a certain degree of erosion resistance. However, further disposition of a thermal spray coating formed of a ceramic coating and/or a cermet coating on the surface of the base material formed of this ferritic stainless steel enables reduction of an alloy deposition reaction (dross attachment) on the surface of the component. Further, the disposition of the thermal spray coating enables improvement in wear resistance of the surface of the component and reduction of wear caused by contact with a steel strip.

Therefore, it becomes possible to use the component for a hot-dip metal plating bath for a longer period of time than when the thermal spray coating is not disposed.

Further, the component for a hot-dip metal plating bath is reusable, because even when the dross attachment occurs on the thermal spray coating due to long-term use, it is possible to remove only the thermal spray coating and recoat the component.

The component for a hot-dip metal plating bath is less likely to cause a crack on the thermal spray coating or peeling between the base material and the thermal spray coating because a coefficient of thermal expansion of the thermal spray coating is close to a coefficient of thermal expansion of the base material formed of the ferritic stainless steel.

The hot-dip Zn—Al plating bath containing high-purity Al requires high-temperature operation due to Al having a high melting point of 550° C. or higher, so that austenite stainless steel (for example, SUS316L) that exhibits excellent molten Zn—Al corrosion resistance and has a high chromium content has been conventionally mainly used as an in-bath component. The austenite stainless steel, however, is largely different in the coefficient of thermal expansion from a cermet material and a ceramic material, so that formation of the thermal spray coating formed of these materials on the base material formed of the austenite stainless steel has not allowed the thermal spray coating to follow expansion of the base material when the in-bath component is exposed to a high temperature of 550° C. or higher, and the formation has thus caused a crack or peeling of the thermal spray coating, not allowing the thermal spray coating to play its primary function.

In contrast, the ferritic stainless steel developed as a raw material for the base material exhibits, in spite of being ferritic stainless steel, excellent molten Zn—Al corrosion resistance and has a coefficient of thermal expansion close to the coefficients of thermal expansion of the cermet material and the ceramic material.

That is, even when covered with the thermal spray coating formed of the ceramic coating and/or the cermet coating, the base material that is formed of the ferritic stainless steel having a specific composition is less likely to cause a crack or peeling of the thermal spray coating. Even when a crack is, by any chance, caused on the thermal spray coating and a plating bath component (molten metal component) penetrates into a surface of the base material, the base material itself is less likely to react with the plating bath component.

In the base material, the crystallized carbide means a carbide deposited from a liquid phase or a solid phase.

(2) In the base material of the component for a hot-dip metal plating bath, it is possible to use cast steel as the ferritic stainless steel.

(3) In the base material of the component for a hot-dip metal plating bath, when the ferritic stainless steel is the cast steel, the crystallized carbide preferably has an area fraction to the microstructure of 5% or more and 30% or less.

(4) In the base material of the component for a hot-dip metal plating bath, when the ferritic stainless steel is the cast steel, the Nb carbide, the Ti carbide, the V carbide, the Ta carbide, and the composite carbide thereof preferably have an area fraction to the microstructure of 3% or more.

(5) In the base material of the component for a hot-dip metal plating bath, it is possible to use forged steel as the ferritic stainless steel.

(6) In the base material of the component for a hot-dip metal plating bath, when the ferritic stainless steel is the forged steel, the Nb carbide, the Ti carbide, the V carbide, the Ta carbide, and the composite carbide thereof preferably have an area fraction to the microstructure of 3% or more.

(7) In the base material of the component for a hot-dip metal plating bath, when the ferritic stainless steel is the forged steel, the crystallized carbide preferably has an area fraction to the microstructure of 3.5% or more and 30% or less.

(8) In the component for a hot-dip metal plating bath, the base material preferably further contains, in place of the Fe, one or two or more selected from the group consisting of:

Cu: 0.02% by mass or more and 2.00% by mass or less;
W: 0.10% by mass or more and 5.00% by mass or less;
Ni: 0.10% by mass or more and 5.00% by mass or less;
Co: 0.01% by mass or more and 5.00% by mass or less;
Mo: 0.05% by mass or more and 5.00% by mass or less;
S: 0.01% by mass or more and 0.50% by mass or less;
N: 0.01% by mass or more and 0.15% by mass or less;
B: 0.005% by mass or more and 0.100% by mass or less;
Ca: 0.005% by mass or more and 0.100% by mass or less;
Al: 0.01% by mass or more and 1.00% by mass or less, and
Zr: 0.01% by mass or more and 0.20% by mass or less.

(9) In the component for a hot-dip metal plating bath, the base material preferably has a P content limited to 0.50% by mass or less.

(10) In the component for a hot-dip metal plating bath, the thermal spray coating is formed of the cermet coating and the ceramic coating, and preferably formed by stacking the cermet coating and the ceramic coating in this order from a base-material side.

(11) In the component for a hot-dip metal plating bath, the thermal spray coating includes the cermet coating, and the cermet coating preferably contains (i) at least either one element of W and Mo, (ii) at least either one element of C and B, (iii) at least any one element of Co, Ni, and Cr, and (iv) at least any one element of Si, F, and Al.

Advantageous Effects of Invention

According to the present invention, it is possible to provide a component for a hot-dip metal plating bath that is less likely to generate dross on a surface of the component, is less likely to cause a crack or peeling of a thermal spray coating, and is less likely to allow erosion of a base material itself.

Such a component for a hot-dip metal plating bath is suitably usable for a hot-dip Zn—Al plating bath containing 50% by mass or more of Al or a hot-dip Al plating bath.

DESCRIPTION OF EMBODIMENTS

Hereinafter, a component for a hot-dip metal plating bath according to an embodiment of the present invention is described with reference to drawings.

The component for a hot-dip metal plating bath is, in a plating apparatus including a hot-dip metal plating bath, suitably usable as a constituent component for the plating apparatus that is in contact with a hot-dip metal plating liquid.

Figure 1:
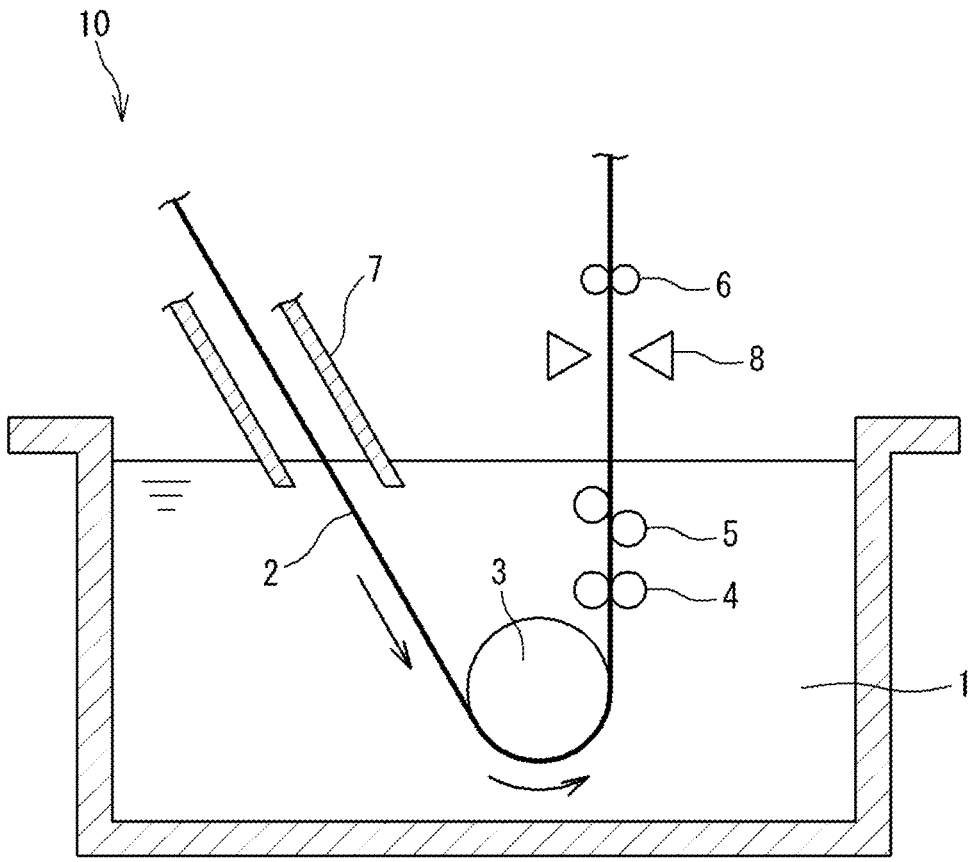
FIG. 1 is a view schematically illustrating one example of a plating apparatus including a hot-dip metal plating bath.
Figure 2:
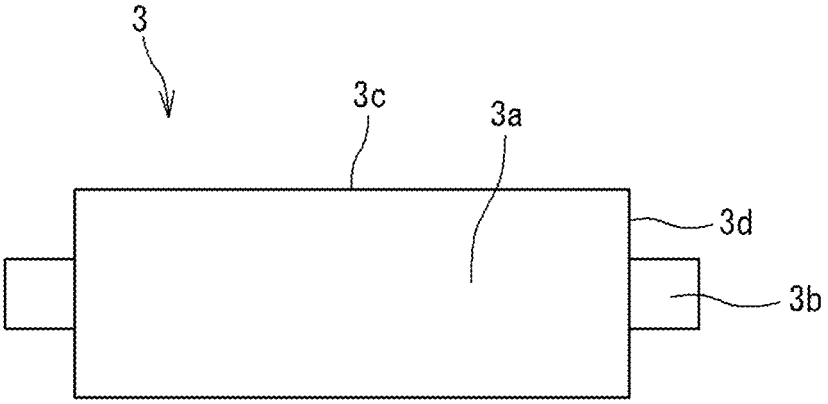
FIG. 2 is a plan view illustrating a sink roll constituting the plating apparatus illustrated in FIG. 1.

FIG. 1 is a view schematically illustrating one example of a plating apparatus including a hot-dip metal plating bath. FIG. 2 is a plan view illustrating a sink roll constituting the plating apparatus illustrated in FIG. 1.

A hot-dip metal plating apparatus 10 illustrated in FIG. 1 is a steel-strip immersion hot-dip metal plating apparatus.

The hot-dip metal plating apparatus 10 includes a hot-dip metal plating bath 1, in which sink roll 3, a support roll 4, and a stabilizer roll 5 are disposed in this order from a steel-strip 2 feeding side, and above which a touch roll 6 is further disposed. In addition, the hot-dip metal plating apparatus 10 includes a snout 7 as an in-bath device, and a wiping nozzle 8 is disposed above the plating bath 1.

The component for a hot-dip metal plating bath according to the embodiment of the present invention is suitably usable as the sink roll 3, the support roll 4, the stabilizer roll 5, the touch roll 6, the snout 7, the wiping nozzle 8, and the like in, for example, the plating apparatus 10.

Further, the component for a hot-dip metal plating bath is also usable as, for example, a plating tub, a transportation pump (not shown), and an agitation jig, in addition to those exemplified above.

Specifically, for example, the sink roll 3 is, as illustrated in FIG. 2, configured to include a cylindrical roll body 3*a* whose side surface conveys the steel strip 2, and a shaft 3*b* that supports the roll body 3*a* and makes the roll body rotatable.

When the component for a hot-dip metal plating bath is used as such a sink roll 3, a thermal spray coating may be disposed only on the roll body 3*a* or on both the roll body 3*a* and the shaft 3*b*. Further, in the roll body 3*a*, the thermal spray coating may be disposed only on a long body part (peripheral surface) 3*c* or on both the long body part 3*c* and an end part (end surface) 3*d*. Since the long body part 3*c* of the roll body 3*a* is a location in contact with the steel strip, the disposition of the thermal spray coating on this location is effective for reduction of wear of the roll body 3*a* and prevention of generation of a flaw on the steel strip.

Thus, the component for a hot-dip metal plating bath is formed of a base material and the thermal spray coating disposed to cover at least part of a surface of the base material.

The component for a hot-dip metal plating bath is configured as described later to be suitable as the component for, for example, a hot-dip aluminum plating bath or a hot-dip Al—Zn alloy plating bath containing 50% by mass or more of Al.

The hot-dip aluminum plating bath is a 100% hot-dip aluminum plating bath. Usually, a bath temperature of this plating bath is set at an aluminum melting point of 660° C. or higher.

The hot-dip Al—Zn alloy plating bath containing 50% by mass or more of Al is, for example, an Al—Zn alloy plating bath (so-called galvalume bath) containing molten zinc and molten aluminum and having an aluminum content of 55% by mass. Usually, a bath temperature of this plating bath is 550° C. or higher.

Hereinafter, the compositions of the base material and the thermal spray coating are described.

The base material is formed of ferritic stainless steel that contains:

C: 0.10% by mass or more and 0.50% by mass or less;

Si: 0.01% by mass or more and 4.00% by mass or less;

Mn: 0.10% by mass or more and 3.00% by mass or less;

Cr: 15.0% by mass or more and 30.0% by mass or less;

a total of Nb, V, Ti, and Ta: 0.9% by mass or more and 5.0% by mass or less; and a balance of Fe and unavoidable impurities, the ferritic stainless steel having:

a microstructure that includes a ferrite phase as a main phase and a crystallized carbide; and an area fraction of a Nb carbide, a Ti carbide, a V carbide, a Ta carbide, and a composite carbide thereof to the crystallized carbide of 30% or more.

The ferritic stainless steel has the ferrite phase as the main phase.

Here, having the ferrite phase as the main phase means that the ferrite phase accounts for 90% or more of the microstructure except the crystallized carbide and a deposited carbide. It is possible to determine a quantity of the ferrite phase from X-ray diffraction intensity obtained in accordance with ordinary XRD measurement, using a mirror-polished test piece. For example, when the ferritic stainless steel is formed of the ferrite phase and an austenite phase, the quantitative determination is performed using ferrite-phase diffraction peaks (110), (200), and (211) and austenite-phase diffraction peaks (111), (200), (220), and (311).

The microstructure constituting the ferritic stainless steel includes the crystallized carbide. The microstructure including the crystallized carbide has an area fraction of the Nb carbide, the Ti carbide, the V carbide, the Ta carbide, and the composite carbide thereof to the crystallized carbide of 30% or more (hereinafter, this area fraction is also referred to as an "area fraction A").

It is very important for the ferritic stainless steel to have the area fraction A in the above range.

The ferritic stainless steel contains elements Cr and at least one of Nb, Ti, V, or Ta. These elements are capable of generating a carbide together with C contained in the ferritic stainless steel.

In the ferritic stainless steel, Cr is a very important element to secure erosion resistance to the plating bath, and the ferritic stainless steel containing a prescribed amount of Cr secures excellent erosion resistance.

On the other hand, Cr is bonded to C to be capable of generating a Cr carbide, and the generation of the Cr carbide consumes Cr to reduce an amount of Cr in a matrix and thus does not sometimes allow the ferritic stainless steel to secure sufficient erosion resistance.

Therefore, the ferritic stainless steel contains a prescribed total amount of Nb, V, Ti, and Ta, and carbides of these elements are present to satisfy an area fraction A of 30% or more. Generation of the carbides of Nb, V, Ti, and Ta more preferentially proceeds than the generation of the Cr carbide due to easy bonding of Nb, V, Ti, and Ta to carbon. Therefore, setting the area fraction A at 30% or more enables suppression of the generation of the Cr carbide, resulting in the ferritic stainless steel capable of securing sufficient erosion resistance.

The ferritic stainless steel may be cast steel or forged steel. Whether the ferritic stainless steel is used as cast steel or forged steel may be appropriately selected according to a size or a type of the component for a hot-dip metal plating bath.

For example, it is possible to provide the component for a hot-dip metal plating bath, e.g., the plating tub as a sand-cast product obtained by casting the ferritic stainless steel into a sand casting mold.

For example, it is possible to manufacture the component for a hot-dip metal plating bath, e.g., the sink roll and the support roll by centrifugal casting or by subjecting a cast ingot to hot forging.

Hereinafter, an embodiment is described in which the ferritic stainless steel constituting the base material is cast steel.

When the ferritic stainless steel is cast steel, an upper limit of the area fraction of A is not particularly limited, but it is possible to set the upper limit at, for example, 85% or less in consideration of balance with the Cr carbide.

The area fraction A is preferably in a range of 30% or more and 65% or less, more preferably in a range of 35% or more and 65% or less. Setting the area fraction A in the above range makes the crystallized carbide (all the carbides) fine to enable the ferritic stainless steel to effectively suppress a crack during solidification and cooling.

A method for calculating the area fraction A is described later in detail.

When the ferritic stainless steel is cast steel, a C content (% by mass) and a content (% by mass) of Nb, Ti, V, and Ta preferably satisfy the following relational expression (1).

$$([Nb]+2[Ti]+2[V]+0.5[Ta])/[C]>3.2 \quad (1)$$

The ferritic stainless steel that contains the elements to satisfy this expression (1) is particularly suitable for setting the area fraction A at 30% or more.

When the expression (1) is satisfied, a total amount of Nb, Ti, V, and Ta is sufficient relative to the C content, so that the ferritic stainless steel is capable of suppressing the generation of the Cr carbide and is thus suitable for satisfying an area fraction A of 30% or more.

Coefficients assigned to Ti, V, and Ta in the expression (1) are those assigned in consideration of a difference between atomic weight of each of the elements and atomic weight of Nb.

When the ferritic stainless steel is cast steel, the crystallized carbide preferably has an area fraction (hereinafter, this area fraction is also referred to as an "area fraction B") to the microstructure of 5% or more and 30% or less. The area fraction B is more preferably 5% or more and 15% or less. Setting a lower limit of the area fraction B at 5% enables a more sufficient amount of a crystallized carbide that contributes to erosion resistance. Setting an upper limit of the area fraction B at 30%, more preferably 15% enables suppression of the generation of a crack starting from the crystallized carbide.

When the ferritic stainless steel is cast steel, the Nb carbide, the Ti carbide, the V carbide, the Ta carbide, and the composite carbide thereof preferably have an area fraction (hereinafter, this area fraction is also referred to as an "area fraction C") to the microstructure of 3% or more. Setting a lower limit of the area fraction C at 3% enables a more sufficient amount of the crystallized carbide that contributes to erosion resistance.

An upper limit of the area fraction C is not particularly limited, but is preferably set at, for example, 10%. Setting the area fraction C at 10% or less makes the crystallized carbide (all the carbides) fine to enable the ferritic stainless steel to effectively suppress a crack during solidification and cooling.

Hereinafter, an embodiment is described in which the ferritic stainless steel constituting the base material is forged steel.

A forging method for obtaining forged steel constituting the base material is not particularly limited, and either cool forging or hot forging may be employed, while the hot forging that facilitates processing is more preferably employed.

When the hot forging is performed, a forging temperature may be set in a range of 1200° C. to 800° C. Further, soaking may be performed in a range of 1200° C. to 1000° C. before the forging as necessary.

When the forged steel is obtained, a heat treatment such as a solution treatment or an aging treatment may be performed after the forging.

The hot forging under the above conditions sometimes makes the Cr carbide form a solid solution because the Cr carbide has a low temperature for forming a solid solution in a mother phase.

On the other hand, even the hot forging under the above conditions little makes the Nb carbide, the Ti carbide, the V carbide, the Ta carbide, and the composite carbide thereof form solid solutions because these carbides have high temperatures for forming a solid solution in a mother phase.

Accordingly, the area fraction C little changes compared to the area fraction C in cast (as-cast) ferritic stainless steel, but the area fractions A and B can change, and therefore, the area fractions A, B, and C of the ferritic stainless steel that is forged steel are described below.

The area fraction C is, as described above, the same as the case where the ferritic stainless steel is cast steel. Therefore, the area fraction C is not described in detail.

The area fraction A is, as in the case where the ferritic stainless steel is cast steel, set at 30% or more to enable suppression of the generation of the Cr carbide, resulting in the ferritic stainless steel that is capable of securing sufficient erosion resistance. Accordingly, the area fraction A is 30% or more at least in the forged steel, and the area fraction A may be less than 30% in the cast (as-cast) ferritic stainless steel that has not been forged.

When the ferritic stainless steel is the forged steel, the C content (% by mass) and the content (% by mass) of Nb, Ti, V, and Ta also preferably satisfy the following relational expression (1).

$$([Nb]+2[Ti]+2[V]+0.5[Ta])/[C]>3.2 \quad (1)$$

The area fraction B is preferably 3.5% or more and 30% or less.

Further, the area fraction B in combination with the other area fractions more preferably satisfies the following: (i) an area fraction A of 30% or more and an area fraction B of 5% or more and 30% or less; and (ii) an area fraction A of 30% or more, an area fraction C of 3% or more, and an area fraction B of 3.5% or more and 30% or less.

For example, when the ferritic stainless steel is the forged steel, hot forging or a heat treatment sometimes make the Cr carbide form a solid solution, and the solid solution of the Cr carbide, i.e., existence of Cr in the matrix makes the base material have excellent erosion resistance to the plating bath. Even in this case, when the requirement (i) or (ii) is satisfied, it is possible to secure a sufficient amount of the crystallized carbide that contributes to erosion resistance.

In the case of the requirement (ii), a further preferable range of the area fraction B is 3.9% to 30%, and setting the area fraction B in this range makes the base material have further excellent erosion resistance.

The ferritic stainless steel has a coefficient of thermal expansion of approximately (9.0 to 11.5)$\times 10^{-6}$/K. Therefore, when a ceramic coating and/or a cermet coating is disposed to cover a surface of the base material formed of the ferritic stainless steel, it is possible to avoid the generation of a crack or damage on these thermal spray coatings.

Hereinafter, described is a reason for limiting a composition of each of the elements in the ferritic stainless steel.

C: 0.10% by Mass or More and 0.50% by Mass or Less

C is capable of improving fluidity during casting and forming a carbide to improve the erosion resistance. Specifically, crystallization of the Cr carbide forms a Cr-deficient area around the Cr carbide to sometimes locally generate a region having poor erosion resistance in the matrix. Therefore, crystallization of the Nb carbide, the Ti carbide, the V carbide, the Ta carbide, or the composite carbide thereof suppresses excessive crystallization of the Cr carbide and enables the matrix to have excellent erosion resistance. In order to obtain such an effect, the ferritic stainless steel necessarily has a content rate of C of 0.10% by mass or more. On the other hand, the ferritic stainless steel having a content rate C of more than 0.50% by mass excessively increases the carbides to be brittle.

Si: 0.01% by Mass or More and 4.00% by Mass or Less

Si is added for deoxidation and securement of castability, while the ferritic stainless steel having a content rate of Si of less than 0.01% by mass has no such effects. On the other hand, the ferritic stainless steel containing more than 4.0% by mass of Si is embrittled or becomes likely to cause a casting defect when used as cast steel. Further, the ferritic stainless steel has poor erosion resistance.

Mn: 0.10% by Mass or More and 3.00% by Mass or Less

Mn contributes to improvement in oxidation resistance characteristics and also acts as a deoxidant for a molten metal. In order to obtain these action effects, the ferritic stainless steel necessarily contains 0.10% by mass or more of Mn. On the other hand, the ferritic stainless steel containing more than 3.00% by mass of Mn makes austenite easily remain to provide a cause of peeling or a crack on the thermal spray coating based on a difference in temporal change of shape (difference in the coefficient of thermal expansion).

Cr: 15.0% by Mass or More and 30.0% by Mass or Less

Cr contributes to improvement in erosion resistance. In order to obtain such an effect, the ferritic stainless steel necessarily contains 15.0% by mass or more of Cr. On the other hand, the ferritic stainless steel containing more than 30.0% by mass of Cr forms a brittle phase, so that when used as cast steel, the ferritic stainless steel significantly deteriorates its castability, resulting in difficult manufacturing of a good cast metal.

Total of Nb, V, Ti, and Ta: 0.9% by Mass or More and 5.0% by Mass or Less

Nb, V, Ti, and Ta are very important elements in the ferritic stainless steel. These elements preferentially form carbides together with C to suppress formation of the Cr carbide and thus contribute to suppression of a decrease in the amount of Cr in the matrix. In order to obtain such an effect, the ferritic stainless steel necessarily contains Nb, V, Ti, and Ta in a total amount of 0.9% by mass or more. On the other hand, the ferritic stainless steel containing Nb, V, Ti, and Ta in a total amount of more than 5.00% by mass forms a coarse carbide, which is sometimes a cause of a crack.

Next, other accessory component elements are described that the ferritic stainless steel can selectively contain.

Cu: 0.02% by Mass or More and 2.00% by Mass or Less

Cu lowers a melting point of the ferritic stainless steel and suppresses the generation of a casting defect such as a sand mark when the ferritic stainless steel is used as cast steel. Cu also serves to remarkably increase corrosion resistance. In order to obtain these effects, the ferritic stainless steel desirably contains 0.02% by mass or more of Cu. On the other hand, the ferritic stainless steel containing more than 2.00% by mass of Cu makes austenite easily remain to sometimes provide a cause of peeling or a crack on the thermal spray coating based on a difference in temporal change of shape (difference in the coefficient of thermal expansion).

W: 0.10% by Mass or More and 5.00% by Mass or Less

W serves to form a solid solution in the matrix and thus increase high-temperature strength. With W being less than the above lower limit value, however, the effect becomes insufficient. The lower limit value of W is desirably set at 0.50% by mass. On the other hand, with W being more than the upper limit value, the steel lowers its ductibility to cause a decrease in, for example, impact resistance. The upper limit value of W is set at desirably 4.00% by mass, more desirably 3.00% by mass.

Ni: 0.10% by Mass or More and 5.00% by Mass or Less

Ni serves to form a solid solution in the matrix and thus increase high-temperature strength. With Ni being less than the above lower limit value, however, the effect becomes insufficient. With Ni being more than the above upper limit value, an $\alpha$ to $\gamma$ phase transformation temperature lowers to decrease a usable upper-limit temperature. With Ni being more than the above upper limit value, the ferritic stainless steel makes austenite easily remain to sometimes provide a cause of peeling or a crack on the thermal spray coating based on a difference in temporal change of shape (difference in the coefficient of thermal expansion). The upper limit value of Ni is set at desirably 3.00% by mass, more desirably 1.00% by mass.

Co: 0.01% by Mass or More and 5.00% by Mass or Less

Co serves to form a solid solution in the matrix and thus increase high-temperature strength. With Co being less than the above lower limit value, however, the effect becomes insufficient. The lower limit value of Co is desirably set at 0.05% by mass. Co is an expensive element, and the upper limit value is thus set as described above. The upper limit value of Co is desirably set at 3.00% by mass.

Mo: 0.05% by Mass or More and 5.00% by Mass or Less

Mo is a ferrite stabilizing element and has an excellent effect of raising the $\alpha$ to $\gamma$ phase transformation temperature. With Mo being less than the above lower limit value, however, the effect becomes insufficient. On the other hand, with Mo being more than the upper limit value, the ferritic stainless steel lowers its ductibility to cause a decrease in, for example, impact resistance. The upper limit value of Mo is set at desirably 3.00% by mass, more desirably 1.00% by mass.

S: 0.01% by Mass or More and 0.50% by Mass or Less

S forms a Mn-based sulfide and improves machinability of the ferritic stainless steel. With S being less than the above lower limit value, the effect becomes insufficient. The lower limit value of S is desirably set at 0.03% by mass. With S being more than the upper limit value, the ferritic stainless steel causes a decrease in ductibility, oxidation resistance, and high-temperature fatigue strength. The upper limit value of S is desirably set at 0.10% by mass.

N: 0.01% by Mass or More and 0.15% by Mass or Less

N has an effect of improving high-temperature strength. With N being less than the above lower limit value, however, the effect becomes insufficient, and with N being more than the upper limit value, the ferritic stainless steel causes a decrease in ductibility.

P: Limited to 0.50% by Mass or Less

P should be limited to the above upper limit value or less, more desirably to 0.10% by mass or less because the ferritic stainless steel containing P lowers its oxidation resistance and high-temperature fatigue strength.

B: 0.005% by Mass or More and 0.100% by Mass or Less

Addition of B is effective for improving machinability. With B being less than the above lower limit value, the effect becomes insufficient, and with B being more than the upper limit value, the ferritic stainless steel causes a decrease in high-temperature fatigue strength.

Ca: 0.005% by Mass or More and 0.100% by Mass or Less

Addition of Ca is effective for improving machinability. With Ca being less than the above lower limit value, the effect becomes insufficient, and with Ca being more than the upper limit value, the ferritic stainless steel causes a decrease in high-temperature fatigue strength.

Al: 0.01% by Mass or More and 1.00% by Mass or Less

Al has effects of stabilizing ferrite and raising the $\alpha$ to $\gamma$ phase transformation temperature and serves to improve high-temperature strength. Therefore, when the usable upper-limit temperature is desired to be further improved, Al may be added. In this case, because 0.01% by mass or less of Al do not give such effects, the lower limit of Al is set at 0.01% by mass. Addition of 1.00% by mass or more of Al, however, not only does not give such effects, but also easily causes a casting defect due to a decrease in fluidity when the ferritic stainless steel is used as cast steel, and also causes a significant decrease in ductibility of the ferritic stainless steel, so that the upper limit of Al is set at 1.00% by mass.

Zr: 0.01% by Mass or More and 0.20% by Mass or Less

Zr has effects of stabilizing ferrite and raising the $\alpha$ to $\gamma$ phase transformation temperature and serves to improve high-temperature strength. Therefore, when the usable upper-limit temperature of the ferritic stainless steel is desired to be further improved, Zr may be added. In this case, because 0.01% by mass or less of Zr do not give such effects, the lower limit of Zr is set at 0.01% by mass. Addition of 0.20% by mass or more of Zr, however, not only does not give such effects, but also causes a significant decrease in ductibility of the ferritic stainless steel, so that the upper limit of Zr is set at 0.20% by mass.

As regards other elements, acceptable contents thereof in a range without making the effects of the present invention unattainable are as follows (a rare-gas element, an artificial element, and a radioelement are excluded because addition of these elements is not realistic).

H, Li, Na, K, Rb, Cs, Fr: each 0.01% by mass or less
Be, Mg, Sr, Ba: each 0.01% by mass or less
Hf: 0.1% by mass or less
Tc, Re: each 0.01% by mass or less
Ru, Os: each 0.01% by mass or less
Rh, Pd, Ag, Ir, Pt, Au: each 0.01% by mass or less
Zn, Cd: each 0.01% by mass or less
Ga, In, Tl: each 0.01% by mass or less
Ge, Sn, Pb: 0.1% by mass or less
As, Sb, Bi, Te: each 0.01% by mass or less
O: 0.02% by mass or less
Se, Te, Po: each 0.1% by mass or less
F, Cl, Br, I, At: each 0.01% by mass or less The base material formed of the ferritic stainless steel described above has excellent erosion resistance to the above-described plating bath component. Therefore, the components for a hot-dip metal plating bath according to the embodiments of the present invention are less likely to be subjected to corrosive attack by the plating bath component even when, for example, a crack is caused on part of the thermal spray coating disposed to cover the surface of the base material, allowing the plating bath component (molten metal component) to penetrate into the surface of the base material.

Next, the thermal spray coating disposed to cover the surface of the base material is described.

The thermal spray coating is a ceramic coating and/or a cermet coating.

A location in which such a thermal spray coating is disposed is less likely to allow attachment of dross than a location in which the thermal spray coating is not disposed. This is because the thermal spray coating has low reactivity with the molten metal.

The ceramic coating is not particularly limited and may be a coating formed of oxide ceramics, a coating formed of carbide ceramics, a coating formed of boride ceramics, a coating formed of fluoride ceramics, or a coating formed of a silicide.

Specific examples of the ceramic coating include a coating containing at least any one of carbides (e.g., tungsten carbide and chromium carbide), borides (e.g., tungsten boride and molybdenum boride), oxides (e.g., alumina, yttria, and chromia), fluorides (e.g., yttrium fluoride and aluminum fluoride), silicides (e.g., tungsten silicide and molybdenum silicide), and composite ceramics of these compounds.

Among these compounds, the ceramic coating is preferably one that contains at least one of a carbide, a boride, or a fluoride. This is because these compounds have low wettability to the molten metal and are particularly suitable for suppressing dross attachment.

The cermet coating is not particularly limited and may be any coating disposed using a thermal spray material containing ceramics and a metal. Examples of the thermal spray material include a thermal spray material containing at least any one of carbides (e.g., tungsten carbide and chromium carbide), borides (e.g., tungsten boride and molybdenum boride), oxides (e.g., alumina, yttria, and chromia), fluorides (e.g., yttrium fluoride and aluminum fluoride), silicides (e.g., tungsten silicide and molybdenum silicide), and composite ceramics of these compounds, and containing, as a binder metal, iron, cobalt, chromium, aluminum, nickel, or an alloy containing at least one of these metals.

The cermet coating is preferably a cermet coating that contains (i) at least either one element of W and Mo, (ii) at least either one element of C and B, (iii) at least any one element of Co, Ni, and Cr, and (iv) at least any one element of Si, F, and Al.

This is because such a cermet coating is particularly suitable for suppressing dross attachment (formation of a reaction layer). Above all, the elements in (ii) and (iv), particularly the elements in (iv) are effective for reducing reactivity with molten zinc and molten aluminum. A combination of the elements in (i) and (ii) is effective for improving wear resistance.

Specific examples of the cermet coatings having the above compositions include a WC—WB—Co—Al coating and a WC—WB—Co—WSi coating.

The thermal spray coating formed of the cermet coating and the ceramic coating is preferably formed by staking the cermet coating and the ceramic coating in this order from a base-material side.

This is because this stacking order allows the thermal spray coating to gradually change its coefficient of thermal expansion and be thus less likely to cause peeling or a crack between the coatings.

It is possible to select the thermal spray coating that has a coefficient of thermal expansion in a range of, for example, $(7.0 \text{ to } 10.0)\times10^{-6}$/K.

From a viewpoint of avoiding peeling or a crack on the thermal spray coating, the thermal spray coating is preferably selected that has a composition giving a small difference in the coefficient of thermal expansion from the base material. Specifically, the difference in the coefficient of thermal expansion between the base material and the thermal spray coating directly on the base material is preferably $4.0\times10^{-6}$/K or less, more preferably $3.0\times10^{-6}$/K or less, further preferably $2.0\times10^{-6}$/K or less.

The thermal spray coating preferably has a thickness of 50 μm to 500 μm.

The thermal spray coating having a thickness of less than 50 μm is sometimes incapable of sufficiently improving the erosion resistance. On the other hand, the thermal spray coating having a thickness of more than 500 μm does not greatly improve the erosion resistance and is likely to cause, for example, a crack or peeling thereon.

The thermal spray coating may be disposed to cover an entire surface of the base material or may be disposed only on part of the surface of the base material.

When disposed only on part of the base material, the thermal spray coating is preferably disposed on a portion in contact with a product to be metal-plated. Specifically, when the component for a hot-dip metal plating bath is, for example, a sink roll, the thermal spray coating is preferably disposed on the roll body.

The component for a hot-dip metal plating bath is preferably applied to a component that is at least partially immersed in the plating bath. When the component is immersed even partially in the plating bath, the molten metal can be deposited as solid matter also on a location of the component that is not immersed in the plating bath.

A sealing layer may be disposed on a surface of the thermal spray coating or a sealer may fill the surface of the thermal spray coating. This is because the sealing layer and the sealer are capable of preventing penetration of the plating bath component into the thermal spray coating.

As a method for forming the thermal spray coating, a method for forming the sealing layer, and a filling method with the sealer, it is possible to employ conventionally known methods.

EXAMPLES

Hereinafter, the present invention is further specifically described by way of examples. The present invention, however, is not limited to the following examples.

(Compositions of Base Materials and Erosion Resistance 1: Test Examples 1 to 29 and Comparative Test Examples 1 to 10)

A slab was manufactured by melting a material having a composition shown in Table 1 (Test Examples 1 to 29) or Table 2 (Comparative Test Examples 1 to 10) and casting the molten material into an element tube having a size of 384 mm (thickness)×280 mm (width)×2305 mm (length). This slab was machined to give a test piece having a size of φ30 mm (diameter)×300 mm (length).

TABLE 1

| | C | Si | Mn | Cr | Nb | Ti | V | Ta | W | Ni | Co | Mo | S | N | P | B | Al | Zr | Cu | Ca | Fe |
|---|---|---|---|---|---|---|---|---|---|---|---|---|---|---|---|---|---|---|---|---|---|
| Test Example 1 | 0.36 | 1.8 | 0.6 | 18.0 | 1.6 | — | — | — | — | — | — | — | — | — | — | — | — | — | — | — | bal. |
| Test Example 2 | 0.30 | 1.5 | 0.5 | 17.4 | 1.1 | — | — | — | — | — | — | — | — | — | — | — | — | — | — | — | bal. |
| Test Example 3 | 0.36 | 1.7 | 0.5 | 17.9 | 2.5 | — | — | — | — | — | — | — | — | — | — | — | — | — | — | — | bal. |
| Test Example 4 | 0.35 | 1.2 | 0.7 | 18.5 | 3.7 | — | — | — | — | — | — | — | — | — | — | — | — | — | — | — | bal. |
| Test Example 5 | 0.37 | 1.3 | 0.8 | 16.9 | — | 0.9 | — | — | — | — | — | — | — | — | — | — | — | — | — | — | bal. |
| Test Example 6 | 0.38 | 1.8 | 0.7 | 18.1 | — | 1.4 | — | — | — | — | — | — | — | — | — | — | — | — | — | — | bal. |
| Test Example 7 | 0.32 | 1.7 | 0.6 | 18.4 | — | — | 1.0 | — | — | — | — | — | — | — | — | — | — | — | — | — | bal. |
| Test Example 8 | 0.31 | 1.6 | 0.6 | 18.2 | — | — | — | 2.1 | — | — | — | — | — | — | — | — | — | — | — | — | bal. |
| Test Example 9 | 0.17 | 1.5 | 0.7 | 18.0 | 1.3 | — | — | — | — | — | — | — | — | — | — | — | — | — | — | — | bal. |
| Test Example 10 | 0.43 | 1.8 | 0.6 | 18.1 | 1.8 | — | — | — | — | — | — | — | — | — | — | — | — | — | — | — | bal. |
| Test Example 11 | 0.33 | 0.5 | 1.2 | 18.4 | 1.7 | — | — | — | — | — | — | — | — | — | — | — | — | — | — | — | bal. |
| Test Example 12 | 0.32 | 2.8 | 0.6 | 18.7 | 1.4 | — | — | — | — | — | — | — | — | — | — | — | — | — | — | — | bal. |
| Test Example 13 | 0.33 | 1.7 | 2.1 | 17.5 | 1.4 | — | — | — | — | — | — | — | — | — | — | — | — | — | — | — | bal. |
| Test Example 14 | 0.32 | 1.1 | 0.8 | 25.7 | 1.7 | — | — | — | — | — | — | — | — | — | — | — | — | — | — | — | bal. |
| Test Example 15 | 0.34 | 1.4 | 0.7 | 18.1 | 1.5 | — | — | — | 0.7 | — | — | — | — | — | — | — | — | — | — | — | bal. |
| Test Example 16 | 0.37 | 1.7 | 0.6 | 18.4 | 1.6 | — | — | — | 4.1 | — | — | — | — | — | — | — | — | — | — | — | bal. |
| Test Example 17 | 0.30 | 1.5 | 0.6 | 18.3 | 1.4 | — | — | — | — | 1.2 | — | — | — | — | — | — | — | — | — | — | bal. |
| Test Example 18 | 0.36 | 1.4 | 0.5 | 18.5 | 1.8 | — | — | — | — | — | 1.1 | — | — | — | — | — | — | — | — | — | bal. |
| Test Example 19 | 0.35 | 1.3 | 0.8 | 18.5 | 1.7 | — | — | — | — | — | — | 0.4 | — | — | — | — | — | — | — | — | bal. |
| Test Example 20 | 0.32 | 1.5 | 0.9 | 18.9 | 1.6 | — | — | — | — | — | — | 4.3 | — | — | — | — | — | — | — | — | bal. |
| Test Example 21 | 0.29 | 1.8 | 1.0 | 18.4 | 1.5 | — | — | — | — | — | — | — | 0.03 | — | — | — | — | — | — | — | bal. |

TABLE 1-continued

| | C | Si | Mn | Cr | Nb | Ti | V | Ta | W | Ni | Co | Mo | S | N | P | B | Al | Zr | Cu | Ca | Fe |
|---|---|---|---|---|---|---|---|---|---|---|---|---|---|---|---|---|---|---|---|---|---|
| Test Example 22 | 0.38 | 1.9 | 1.2 | 18.2 | 1.9 | — | — | — | — | — | — | — | — | 0.04 | — | — | — | — | — | — | bal. |
| Test Example 23 | 0.32 | 2.0 | 1.5 | 18.3 | 1.5 | — | — | — | — | — | — | — | — | — | 0.05 | — | — | — | — | — | bal. |
| Test Example 24 | 0.35 | 1.8 | 1.2 | 18.7 | 1.7 | — | — | — | — | — | — | — | — | — | — | 0.02 | — | — | — | — | bal. |
| Test Example 25 | 0.32 | 1.5 | 1.1 | 18.6 | 1.4 | — | — | — | — | — | — | — | — | — | — | — | — | — | — | — | bal. |
| Test Example 26 | 0.35 | 1.7 | 0.6 | 17.9 | 1.8 | — | — | — | — | — | — | — | — | — | — | — | 0.13 | — | — | — | bal. |
| Test Example 27 | 0.36 | 1.6 | 0.5 | 19.1 | 1.7 | — | — | — | — | — | — | — | — | — | — | — | — | 0.05 | — | — | bal. |
| Test Example 28 | 0.32 | 1.4 | 0.7 | 17.9 | 1.6 | — | — | — | — | — | — | — | — | — | — | — | — | — | 0.8 | — | bal. |
| Test Example 29 | 0.33 | 1.6 | 0.4 | 18.5 | 1.7 | — | — | — | — | — | — | — | — | — | — | — | — | — | — | 0.07 | bal. |

TABLE 2

| | C | Si | Mn | Cr | Nb | Ti | V | Ta | Fe |
|---|---|---|---|---|---|---|---|---|---|
| Comparative Test Example 1 | 0.66 | 1.5 | 0.7 | 17.5 | 1.1 | — | — | — | bal. |
| Comparative Test Example 2 | 0.08 | 1.5 | 0.6 | 17.9 | 1.6 | — | — | — | bal. |
| Comparative Test Example 3 | 0.49 | 1.3 | 0.6 | 18.1 | 0.9 | — | — | — | bal. |
| Comparative Test Example 4 | 0.33 | 1.6 | 0.9 | 11.2 | 1.8 | — | — | — | bal. |
| Comparative Test Example 5 | 0.32 | 1.7 | 0.8 | 18.2 | 0.7 | — | — | — | bal. |
| Comparative Test Example 6 | 0.38 | 1.4 | 0.6 | 13.4 | 0.8 | — | — | — | bal. |
| Comparative Test Example 7 | 0.12 | 1.9 | 0.7 | 5.1 | 0.7 | — | — | — | bal. |
| Comparative Test Example 8 | 0.11 | 1.8 | 1.0 | 12.2 | 0.5 | — | — | — | bal. |
| Comparative Test Example 9 | 0.36 | 1.0 | 0.5 | 18.5 | — | 0.2 | — | — | bal. |
| Comparative Test Example 10 | 0.33 | 1.9 | 0.2 | 18.3 | — | — | 0.3 | — | bal. |

(Evaluation of Test Pieces)

[Thickness Loss]

The test piece was immersed for 120 hours in a hot-dip Zn—Al—Si bath (galvalume bath) that was heated to 600° C. and contained 43.4% by mass of Zn, 55% by mass of Al, and 1.6% by mass of Si, and then was pulled out from the hot-dip Zn—Al—Si bath. The test piece was cut along a direction perpendicular to a longitudinal direction of the test piece for a sectional observation image, from which an outer-diameter reduced amount was determined, and the reduced amount was defined as thickness loss of the test piece. Table 3 shows the results.

Here, the thickness loss was rounded off to two decimal places, and calculated as a hundredths-place value (unit: mm). Thereafter, the test piece was evaluated under the following criteria, and the evaluation result was classified into "A" to "C". Table 3 shows the results.

A: thickness loss of 0.41 mm or less.

B: thickness loss of 0.42 mm to 0.47 mm.

C: thickness loss of 0.48 mm or more

[Area Fractions of Crystallized Carbides]

The test piece was subjected to mirror finishing to give a measurement sample, and any 10 places of the measurement sample were observed at 400-fold magnification with a scanning electron microscope (SEM). An observation area per one field is 0.066 $mm^2$.

Figure 3:
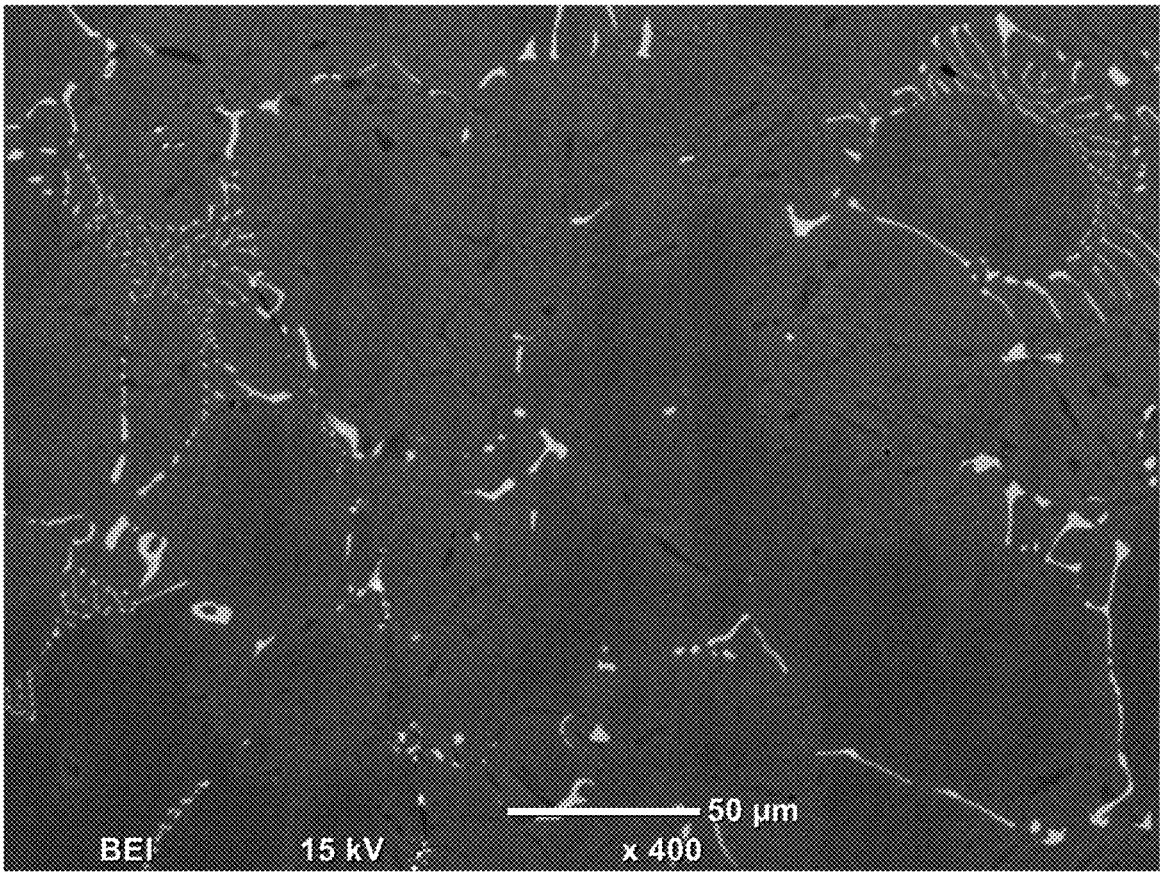
FIG. 3 is one of SEM photographs of a test piece produced in Test Example 1.

FIG. 3 illustrates one of observation images obtained in the SEM observation of the test piece according to Test Example 1.

Crystallized carbides in the observation images (reflection electron images obtained through the SEM observation) obtained at the 10 places of the measurement sample were sorted into a Cr carbide, a Nb carbide, a Ti carbide, a V carbide, and a Ta carbide by EDX, a total area of each of the crystallized carbides was calculated with WinROOF (manufactured by MITANI CORPORATION).

Further, a total of total areas of the crystallized carbides (total area of all the crystallized carbides) was calculated.

Thereafter, the following area fractions (ratios of crystallized carbides) were calculated.

As a method for sorting the carbides, a contrast in the reflection electron image may be utilized. For example, FIG. 3 clarifies that the Nb carbide is observed whiter than the Cr carbide. This method is capable of further facilitating the sorting of the carbides.

(A) Ratio of Nb carbide, Ti carbide, V carbide, Ta carbide, and composite carbide thereof to all crystallized carbides (area fraction A (%))

A sum of the total areas of the Nb carbide, the Ti carbide, the V carbide, the Ta carbide, and the composite carbide thereof was calculated, and the calculated value was divided by the total area of all the crystallized carbides to calculate the area fraction A. Table 3 shows the results.

(B) Ratio of all crystallized carbides to microstructure (area fraction B (%))

The total area of all the crystallized carbides was divided by a total field area (10 places×area (0.66 $mm^2$) per one field) to calculate the area fraction B. Table 3 shows the results.

(C) Ratio of Nb carbide, Ti carbide, V carbide, Ta carbide, and composite carbide thereof to microstructure (area fraction C (%))

The sum of the total areas of the Nb carbide, the Ti carbide, the V carbide, the Ta carbide, and the composite carbide thereof was divided by the total field area to calculate the area fraction C. Table 3 shows the results.

TABLE 3

| | Total of Nb, Ti, V, and Ta (% by mass) | Area fraction A (%) | Area fraction B (%) | Area fraction C (%) | (Nb + 2Ti + 2V + 0.5Ta)/C | Thickness loss (mm) | Evaluation |
|---|---|---|---|---|---|---|---|
| Test Example 1 | 1.6 | 42 | 8.1 | 3.4 | 4.4 | 0.41 | A |
| Test Example 2 | 1.1 | 32 | 7.3 | 2.3 | 3.7 | 0.44 | B |
| Test Example 3 | 2.5 | 71 | 6.5 | 4.6 | 6.9 | 0.37 | A |
| Test Example 4 | 3.7 | 82 | 6.1 | 5.0 | 10.6 | 0.35 | A |
| Test Example 5 | 0.9 | 38 | 7.2 | 2.7 | 4.9 | 0.43 | B |
| Test Example 6 | 1.4 | 72 | 6.6 | 4.8 | 7.4 | 0.39 | A |
| Test Example 7 | 1.0 | 43 | 6.3 | 2.7 | 6.3 | 0.42 | B |
| Test Example 8 | 2.1 | 31 | 7.2 | 2.2 | 3.4 | 0.44 | B |
| Test Example 9 | 1.3 | 79 | 3.8 | 3.0 | 7.6 | 0.47 | B |
| Test Example 10 | 1.8 | 35 | 9.1 | 3.2 | 4.2 | 0.37 | A |
| Test Example 11 | 1.7 | 43 | 7.3 | 3.1 | 5.2 | 0.36 | A |
| Test Example 12 | 1.4 | 36 | 6.9 | 2.5 | 4.4 | 0.43 | B |
| Test Example 13 | 1.4 | 32 | 7.6 | 2.4 | 4.2 | 0.42 | B |
| Test Example 14 | 1.7 | 51 | 7.0 | 3.6 | 5.3 | 0.34 | A |
| Test Example 15 | 1.5 | 39 | 7.7 | 3.0 | 4.4 | 0.41 | A |
| Test Example 16 | 1.6 | 39 | 8.2 | 3.2 | 4.3 | 0.38 | A |
| Test Example 17 | 1.4 | 42 | 7.1 | 3.0 | 4.7 | 0.41 | A |
| Test Example 18 | 1.8 | 40 | 7.5 | 3.0 | 5.0 | 0.41 | A |
| Test Example 19 | 1.7 | 41 | 7.7 | 3.2 | 4.9 | 0.39 | A |
| Test Example 20 | 1.6 | 46 | 7.3 | 3.4 | 5.0 | 0.40 | A |
| Test Example 21 | 1.5 | 47 | 6.5 | 3.1 | 5.2 | 0.41 | A |
| Test Example 22 | 1.9 | 48 | 8.5 | 4.1 | 5.0 | 0.38 | A |
| Test Example 23 | 1.5 | 39 | 7.6 | 3.0 | 4.7 | 0.41 | A |
| Test Example 24 | 1.7 | 41 | 8.1 | 3.3 | 4.9 | 0.40 | A |
| Test Example 25 | 1.4 | 42 | 7.1 | 3.0 | 4.4 | 0.38 | A |
| Test Example 26 | 1.8 | 43 | 7.7 | 3.3 | 5.1 | 0.40 | A |
| Test Example 27 | 1.7 | 40 | 8.1 | 3.2 | 4.7 | 0.39 | A |
| Test Example 28 | 1.6 | 39 | 7.8 | 3.0 | 5.0 | 0.41 | A |
| Test Example 29 | 1.7 | 38 | 8.3 | 3.2 | 5.2 | 0.40 | A |
| Comparative Test Example 1 | 1.1 | 24 | 14.1 | 3.4 | 1.7 | 0.54 | C |
| Comparative Test Example 2 | 1.6 | 84 | 2.5 | 2.1 | 20.0 | 0.56 | C |
| Comparative Test Example 3 | 0.9 | 15 | 12.2 | 1.8 | 1.8 | 0.57 | C |
| Comparative Test Example 4 | 1.8 | 41 | 7.3 | 3.0 | 5.5 | 0.63 | C |
| Comparative Test Example 5 | 0.7 | 15 | 8.9 | 1.3 | 2.2 | 0.55 | C |
| Comparative Test Example 6 | 0.8 | 12 | 9.4 | 1.1 | 2.1 | 0.64 | C |
| Comparative Test Example 7 | 0.7 | 71 | 3.4 | 2.4 | 5.8 | 0.71 | C |
| Comparative Test Example 8 | 0.5 | 64 | 3.2 | 2.0 | 4.5 | 0.67 | C |
| Comparative Test Example 9 | 0.2 | 10 | 9.6 | 1.0 | 1.1 | 0.56 | C |
| Comparative Test Example 10 | 0.3 | 14 | 8.5 | 1.2 | 1.8 | 0.54 | C |

As Table 3 shows the results, the base materials formed of the ferritic stainless cast steel had excellent erosion resistance to the hot-dip Al—Zn alloy plating bath.

(Compositions of Base Materials and Erosion Resistance 2: Test Examples 30 to 58)

Each of cast materials having the same compositions as Text Example 1 to 29 and having a size of φ150×380 was melted and subjected to hot forging to give a slab having a size of φ40.

Thereafter, the slab was machined to give a test piece having a size of φ30 mm (diameter)×300 mm (length).

[Thickness Loss]

The obtained test pieces were evaluated for the thickness loss in the same manner as for Test Examples 1 to 29. Table 4 shows the results.

[Area Fractions of Crystallized Carbides]

Each of the obtained test pieces was subjected to the SEM observation in the same manner as for Test Examples 1 to 29 except that the observation magnification was changed to 1000-fold magnification. Since an observation area per one field was 0.011 $mm^2$, any 60 places of the measurement sample were observed with an SEM to make the total field area consistent with the above total field area.

Thereafter, the test pieces were subjected to the EDX analysis and the image analysis with WinROOF to evaluate the area fractions A, B, and C in the same manner as for Test Examples 1 to 29. Table 4 shows the results.

Figure 4:
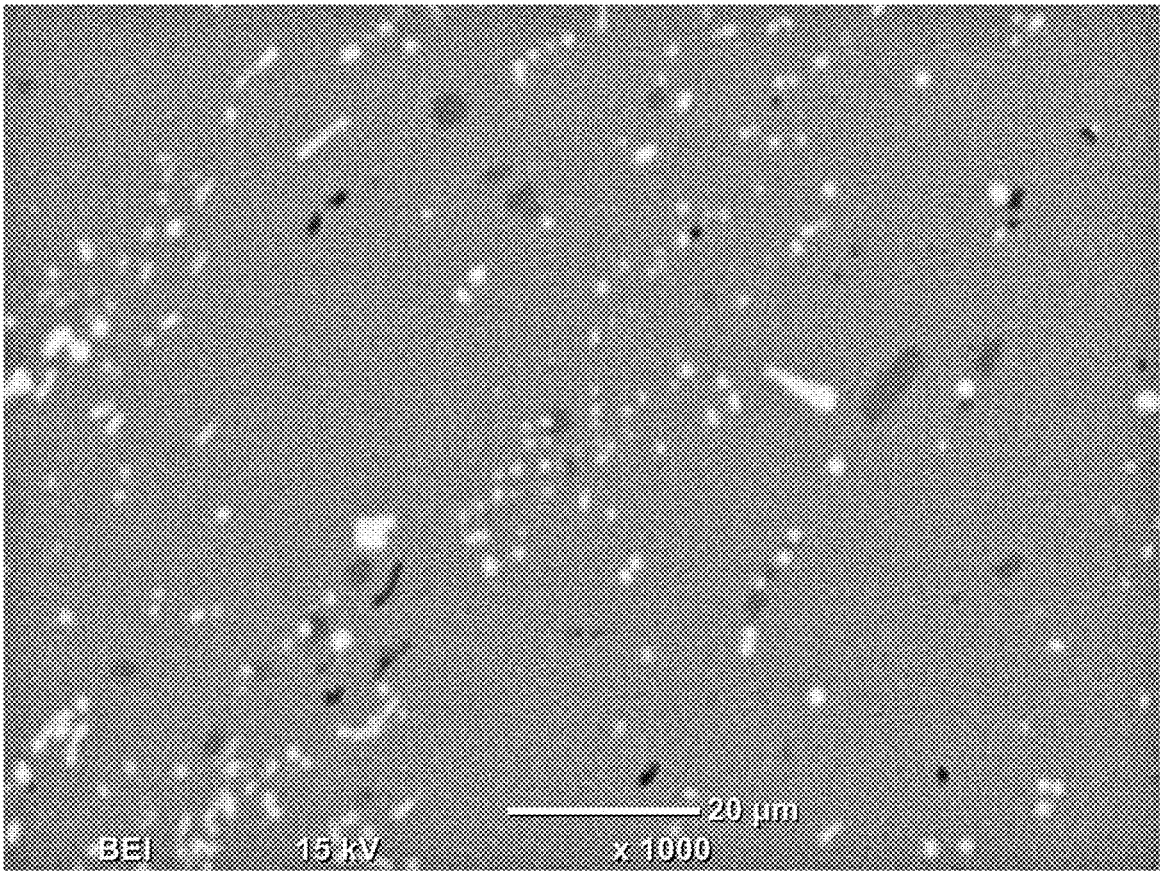
FIG. 4 is one of SEM photographs of a test piece produced in Test Example 30.

FIG. 4 illustrates one of observation images obtained in the SEM observation of the test piece according to Test Example 30.

As is clear from FIG. 4, it is possible to confirm finer crystallized carbides formed through the forging than when the ferritic stainless steel is cast steel.

Observation with a small observation magnification sometimes misses a fine crystallized carbide in the calculation of the area fractions A to C, and therefore, the observation magnification may be set at a magnification larger than a minimum magnification that enables the observation of a target carbide.

For example, in Test Examples 1 to 29, a change in the observation magnification from 400-fold to 1000-fold magnification made no difference in the calculated values of the area fractions A to C.

TABLE 4

| | Component | Area fraction A (%) | Area fraction B (%) | Area fraction C (%) | Thickness loss (mm) | Evaluation |
|---|---|---|---|---|---|---|
| Test Example 30 | Same as Test Example 1 | 70 | 4.6 | 3.2 | 0.41 | A |
| Test Example 31 | Same as Test Example 2 | 65 | 3.7 | 2.4 | 046 | B |
| Test Example 32 | Same as Test Example 3 | 84 | 5.6 | 4.7 | 0.36 | A |
| Test Example 33 | Same as Test Example 4 | 87 | 5.5 | 4.8 | 0.34 | A |
| Test Example 34 | Same as Test Example 5 | 70 | 4.0 | 2.8 | 0.45 | B |
| Test Example 35 | Same as Test Example 6 | 86 | 5.5 | 4.8 | 0.38 | A |
| Test Example 36 | Same as Test Example 7 | 73 | 3.9 | 2.8 | 0.45 | B |
| Test Example 37 | Same as Test Example 8 | 61 | 3.6 | 2.2 | 0.47 | B |
| Test Example 38 | Same as Test Example 9 | 89 | 3.4 | 3.0 | 0.42 | B |
| Test Example 39 | Same as Test Example 10 | 68 | 4.8 | 3.3 | 0.36 | A |
| Test Example 40 | Same as Test Example 11 | 71 | 4.5 | 3.2 | 0.36 | A |
| Test Example 41 | Same as Test Example 12 | 69 | 3.5 | 2.4 | 0.44 | B |
| Test Example 42 | Same as Test Example 13 | 66 | 3.8 | 2.5 | 0.44 | B |

TABLE 4-continued

| | Component | Area fraction A (%) | Area fraction B (%) | Area fraction C (%) | Thickness loss (mm) | Evaluation |
|---|---|---|---|---|---|---|
| Test Example 43 | Same as Test Example 14 | 78 | 4.5 | 3.5 | 0.36 | A |
| Test Example 44 | Same as Test Example 15 | 72 | 4.3 | 3.1 | 0.40 | A |
| Test Example 45 | Same as Test Example 16 | 71 | 4.5 | 3.2 | 0.38 | A |
| Test Example 46 | Same as Test Example 17 | 74 | 4.1 | 3.1 | 0.41 | A |
| Test Example 47 | Same as Test Example 18 | 72 | 4.6 | 3.3 | 0.41 | A |
| Test Example 48 | Same as Test Example 19 | 74 | 4.7 | 3.5 | 0.38 | A |
| Test Example 49 | Same as Test Example 20 | 73 | 4.2 | 3.1 | 0.41 | A |
| Test Example 50 | Same as Test Example 21 | 74 | 4.2 | 3.1 | 0.39 | A |
| Test Example 51 | Same as Test Example 22 | 75 | 5.1 | 3.8 | 0.38 | A |
| Test Example 52 | Same as Test Example 23 | 67 | 4.4 | 3.0 | 0.39 | A |
| Test Example 53 | Same as Test Example 24 | 71 | 4.7 | 3.3 | 0.40 | A |
| Test Example 54 | Same as Test Example 25 | 69 | 4.4 | 3.1 | 0.39 | A |
| Test Example 55 | Same as Test Example 26 | 74 | 4.6 | 3.4 | 0.38 | A |
| Test Example 56 | Same as Test Example 27 | 69 | 4.8 | 3.3 | 0.40 | A |
| Test Example 57 | Same as Test Example 28 | 69 | 4.5 | 3.1 | 0.41 | A |
| Test Example 58 | Same as Test Example 29 | 72 | 4.4 | 3.2 | 0.39 | A |

As Table 4 shows the results, the base materials formed of the ferritic stainless forged steel also had excellent erosion resistance to the hot-dip Al—Zn alloy plating bath.

Examples and Comparative Examples

Here, 4 types of base materials (base materials A to D: all the base materials are round bars having a size of φ20 mm×130 mm (length) and a round tip) were prepared, and a thermal spray coating was disposed to cover a surface of each of the base materials to produce a component, which was evaluated.

(Raw Material for Base Materials A to D)

Base material A: ferritic stainless steel (coefficient of thermal expansion: $10.0\times10^{-6}$/K) of Test Example 1

Base material B: SUS403 (martensite stainless steel, coefficient of thermal expansion: $9.9\times10^{-6}$/K)

Base material C: SUS430 (ferritic stainless steel, coefficient of thermal expansion: $10.4\times10^{-6}$/K)

Base material D: SUS316L (austenite stainless steel, coefficient of thermal expansion: $16.0\times10^{-6}$/K)

The coefficients of thermal expansion are values calculated from linear expansion in 293 K (room temperature) to 373 K.

(Dross Attachment Property of Base Materials A to D)

Each of the base materials A to D was immersed for 480 hours in a hot-dip Zn—Al—Si bath (galvalume bath) that was heated to 600° C. and contained 43.4% by mass of Zn, 55% by mass of Al, and 1.6% by mass of Si, and then was pulled out from the hot-dip Zn—Al—Si bath. The base material was cut along a direction perpendicular to a longitudinal direction of the test piece and subjected to sectional observation to measure a thickness of a reaction layer. Table 5 shows the results. In this evaluation, a smaller thickness of the reaction layer means less dross attachment.

TABLE 5

| | Corrosion resistance (thickness of reaction layer: μm) |
|---|---|
| Base material A (Test Example 1) | 95 |
| Base material B (SUS403) | 1100 |
| Base material C (SUS430) | 230 |
| Base material D (SUS316L) | 100 |

Examples 1(a) to 1(l)

Components were produced by using the base materials A as the base material and forming thermal spray coatings A to L to cover surfaces of the base materials A.

Comparative Examples 1(a) to 1(l)

Components were produced by using the base materials B as the base material and forming the thermal spray coatings A to L to cover surfaces of the base materials B.

Comparative Examples 2(a) to 2(l)

Components were produced by using the base materials C as the base material and forming the thermal spray coatings A to L to cover surfaces of the base materials C.

Comparative Examples 3(a) to 3(l)

Components were produced by using the base materials D as the base material and forming the thermal spray coatings A to L to cover surfaces of the base materials D.

Compositions, thicknesses, coefficients of thermal expansion, and forming methods of the thermal spray coatings A to L are as described below. The following coefficients of thermal expansion are values calculated from linear expansion in 293 K (room temperature) to 373 K.

[Thermal Spray Coating A]

Composition: WC—Co, Thickness: 100 μm, Coefficient of thermal expansion: $7.2\times10^{-6}$/K, Forming method: high velocity oxygen-fuel flame spraying

[Thermal Spray Coating B]

Composition: WC—NiCr, Thickness: 100 μm, Coefficient of thermal expansion: $8.5\times10^{-6}$/K, Forming method: high velocity oxygen-fuel flame spraying

[Thermal Spray Coating C]

Composition: WC-hastelloy C, Thickness: 100 μm, Coefficient of thermal expansion: $9.0\times10^{-6}$/K, Forming method: high velocity oxygen-fuel flame spraying

[Thermal Spray Coating D]

Composition: WC—Ni, Thickness: 100 μm, Coefficient of thermal expansion: $8.0\times10^{-6}$/K, Forming method: high velocity oxygen-fuel flame spraying

[Thermal Spray Coating E]

Composition: WB—CoCrMo, Thickness: 100 μm, Coefficient of thermal expansion: $9.2\times10^{-6}$/K, Forming method: high velocity oxygen-fuel flame spraying

[Thermal spray coating F]

Composition: MoB—CoCrW, Thickness: 100 μm, Coefficient of thermal expansion: $9.3\times10^{-6}$/K, Forming method: high velocity oxygen-fuel flame spraying

[Thermal Spray Coating G]

Composition: $Al_2O_3$—$ZrO_2$, Thickness: 100 μm, Coefficient of thermal expansion: $9.0\times10^{-6}$/K, Forming method: atmospheric plasma spraying

[Thermal Spray Coating H]

Composition: $Y_2O_3$—$ZrO_2$, Thickness: 100 μm, Coefficient of thermal expansion: $9.5\times10^{-6}$/K, Forming method: atmospheric plasma spraying (Evaluation)

(1) Each of the components produced in (a) to (l) of each of Example 1 to Comparative Example 3 was immersed for 480 hours in a hot-dip Zn—Al—Si bath (galvalume bath) that was heated to 600° C. and contained 43.4% by mass of Zn, 55% by mass of Al, and 1.6% by mass of Si, and then was pulled out from the hot-dip Zn—Al—Si bath. The component was observed for a state of its thermal spray coating (presence or absence of a crack or peeling of the thermal spray coating). Table 6 shows the results.

(2) Each of the components produced in Examples 1(a) to (l) was observed for the state of its thermal spray coating in the above (1), then cut along a direction perpendicular to a longitudinal direction of the component, and subjected to sectional observation to measure a thickness of a reaction layer. Table 6 shows the results.

TABLE 6

| | Example 1 ((a)-(I)) Base material A (Test Example 1) | | Comparative Example 1 ((a)-(I)) Base material B | Comparative Example 2 ((a)-(I)) Base material C | Comparative Example 3 ((a)-(I)) Base material D |
|---|---|---|---|---|---|
| | Peeling/crack on thermal spray coating | Thickness of reaction layer (μm) | (SUS403) Peeling/crack on thermal spray coating | (SUS430) Peeling/crack on thermal spray coating | (SUS316L) Peeling/crack on thermal spray coating |
| (a) Thermal spray coating A (WC—Co) | Not observed | 30 | Not observed | Not observed | Observed |
| (b) Thermal spray coating B (WC—NiCr) | Not observed | 65 | Not observed | Not observed | Observed |
| (c) Thermal spray coating C (WC-hastelloy C) | Not observed | 65 | Not observed | Not observed | Observed |
| (d) Thermal spray coating D (WC—Ni) | Not observed | 60 | Not observed | Not observed | Observed |
| (e) Thermal spray coating E (WB—CoCrMo) | Not observed | 15 | Not observed | Not observed | Observed |
| (f) Thermal spray coating F (MoB—CoCrW) | Not observed | 20 | Not observed | Not observed | Observed |
| (g) Thermal spray coating G ($Al_2O_3$—$ZrO_2$) | Not observed | 50 | Not observed | Not observed | Observed |
| (h) Thermal spray coating H ($Y_2O_3$—$ZrO_2$) | Not observed | 20 | Not observed | Not observed | Observed |
| (i) Thermal spray coating I ($Al_2O_3$) | Not observed | 20 | Not observed | Not observed | Observed |
| (j) Thermal spray coating J (WC—WB—Co—Al) | Not observed | 5 | Not observed | Not observed | Observed |
| (k) Thermal spray coating K (WC—WB—Co—WSi) | Not observed | 5 | Not observed | Not observed | Observed |
| (l) Thermal spray coating L (WC—WB—Co—Al (with sealing layer)) | Not observed | 5 | Not observed | Not observed | Observed |

[Thermal Spray Coating I]

Composition: $Al_2O_3$, Thickness: 100 μm, Coefficient of thermal expansion: $7.0\times10^{-6}$/K, Forming method: atmospheric plasma spraying

[Thermal Spray Coating J]

Composition: WC—WB—Co—Al, Thickness: 100 μm, Coefficient of thermal expansion: $9.2\times10^{-6}$/K, Forming method: high velocity oxygen-fuel flame spraying

[Thermal Spray Coating K]

Composition: WC—WB—Co—WSi, Thickness: 100 μm, Coefficient of thermal expansion: $8.9\times10^{-6}$/K, Forming method: high velocity oxygen-fuel flame spraying

[Thermal Spray Coating L]

Composition: WC—WB—Co—Al (with $YF_3$ sealing layer on surface layer), Thickness: 110 μm (sealing layer: 10 μm), Coefficient of thermal expansion: $9.2\times10^{-6}$/K, Forming method: high velocity oxygen-fuel flame spraying As Table 6 shows the results, the components each obtained by disposing the thermal spray coating on the surface of the base material A were less likely to cause a crack or damage on the thermal spray coating and were less likely to form (allow attachment of) a reaction layer (dross) on the surface.

The invention claimed is:

1. A component for a hot-dip metal plating bath, the component comprising a base material and a thermal spray coating disposed to cover at least part of a surface of the base material, the base material being formed of ferritic stainless steel that contains:

C: 0.10% by mass or more and 0.50% by mass or less;

Si: 0.01% by mass or more and 4.00% by mass or less;

Mn: 0.10% by mass or more and 3.00% by mass or less;

Cr: 15.0% by mass or more and 30.0% by mass or less;
a total of Nb, V, Ti, and Ta: 0.9% by mass or more and 5.0% by mass or less; and
a balance of Fe and unavoidable impurities,
the ferritic stainless steel having:
a microstructure that includes a ferrite phase as a main phase and a crystallized carbide; and
a first area fraction of a Nb carbide, a Ti carbide, a V carbide, a Ta carbide, and a composite carbide thereof to the crystallized carbide of 30% or more, wherein the first area fraction is calculated sorting all crystallized carbides included in a reflection electron image of the base material obtained using a scanning electron microscope are calculating a total area of all the crystallized carbides and total areas of the Nb carbide, the Ti carbide, the V carbide, the Ta carbide, and the composite carbide thereof, and applying equation (A):

area fraction equals the sum of the total areas of the Nb carbide, the Ti carbide, the V carbide, the Ta carbide, and the composite carbide thereof divided by the total area of all the crystallized carbides; (A)

the thermal spray coating being formed of a ceramic coating and/or a cermet coating, and
the component being used for a hot-dip Zn—Al plating bath containing 50% by mass or more of Al or a hot-dip Al plating bath.

2. The component for a hot-dip metal plating bath according to claim 1, wherein the ferritic stainless steel is cast steel.

3. The component for a hot-dip metal plating bath according to claim 2, wherein the base material has a second area fraction of the crystallized carbide to the microstructure of 5% or more and 30% or less,
wherein the second area fraction of the base material is calculated by sorting all crystallized carbides included in a reflection electron image of the base material obtained using a scanning electron microscope and by calculating a total area of all the crystallized carbides, and applying equation (B):

area fraction equals a total area of all the crystallized carbides divided by a total area of the reflection electron image. (B)

4. The component for a hot-dip metal plating bath according to claim 3, wherein the base material has a third area fraction of the Nb carbide, the Ti carbide, the V carbide, the Ta carbide, and the composite carbide thereof to the microstructure of 3% or more
wherein the third area fraction is calculated by sorting all crystallized carbides included in a reflection electron image of the base material obtained using a scanning electron microscope and by calculating total areas of the Nb carbide, the Ti carbide, the V carbide, the Ta carbide, and the composite carbide thereof and applying equation (C):

area fraction equals a sum of the total areas of the Nb carbide, the Ti carbide, the V carbide, the Ta carbide, and the composite carbide thereof divided by a total area of the reflection electron image. (C)

5. The component for a hot-dip metal plating bath according to claim 1, wherein the ferritic stainless steel is forged steel.

6. The component for a hot-dip metal plating bath according to claim 5, wherein the base material has a third area fraction of the Nb carbide, the Ti carbide, the V carbide, the Ta carbide, and the composite carbide thereof to the microstructure of 3% or more
wherein the third area fraction is calculated by sorting all crystallized carbides included in a reflection electron image of the base material obtained using a scanning electron microscope and by calculating total areas of the Nb carbide, the Ti carbide, the V carbide, the Ta carbide, and the composite carbide thereof and applying equation (C):

area fraction equals a sum of the total areas of the Nb carbide, the Ti carbide, the V carbide, the Ta carbide, and the composite carbide thereof divided by a total area of the reflection electron image. (C)

7. The component for a hot-dip metal plating bath according to claim 6, wherein the base material has a second area fraction of the crystallized carbide to the microstructure of 3.5% or more and 30% or less,
wherein the second area fraction of the base material is calculated by sorting all crystallized carbides included in a reflection electron image of the base material obtained using a scanning electron microscope and by calculating a total area of all the crystallized carbides, and applying equation (B):

area fraction equals a total area of all the crystallized carbides divided by a total area of the reflection electron image. (B)

8. The component for a hot-dip metal plating bath according to claim 1, wherein the base material further contains one or two or more selected from the group consisting of:
Cu: 0.02% by mass or more and 2.00% by mass or less;
W: 0.10% by mass or more and 5.00% by mass or less;
Ni: 0.10% by mass or more and 5.00% by mass or less;
Co: 0.01% by mass or more and 5.00% by mass or less;
Mo: 0.05% by mass or more and 5.00% by mass or less;
S: 0.01% by mass or more and 0.50% by mass or less;
N: 0.01% by mass or more and 0.15% by mass or less;
B: 0.005% by mass or more and 0.100% by mass or less;
Ca: 0.005% by mass or more and 0.100% by mass or less;
Al: 0.01% by mass or more and 1.00% by mass or less, and
Zr: 0.01% by mass or more and 0.20% by mass or less.

9. The component for a hot-dip metal plating bath according to claim 1, wherein the base material has a P content limited to 0.50% by mass or less.

10. The component for a hot-dip metal plating bath according to claim 1, wherein the thermal spray coating is formed of the cermet coating and the ceramic coating, and is formed by stacking the cermet coating and the ceramic coating in this order from a base-material side.

11. The component for a hot-dip metal plating bath according to claim 1, wherein
the thermal spray coating includes the cermet coating, and
the cermet coating contains (i) at least either one element of W and Mo, (ii) at least either one element of C and B, (iii) at least any one element of Co, Ni, and Cr, and (iv) at least one element of Al.

12. The component for a hot-dip metal plating bath according to claim 5, wherein the base material further contains one or two or more selected from the group consisting of:
Cu: 0.02% by mass or more and 2.00% by mass or less;
W: 0.10% by mass or more and 5.00% by mass or less;
Ni: 0.10% by mass or more and 5.00% by mass or less;
Co: 0.01% by mass or more and 5.00% by mass or less;
Mo: 0.05% by mass or more and 5.00% by mass or less;
S: 0.01% by mass or more and 0.50% by mass or less;
N: 0.01% by mass or more and 0.15% by mass or less;

B: 0.005% by mass or more and 0.100% by mass or less;

Ca: 0.005% by mass or more and 0.100% by mass or less;

Al: 0.01% by mass or more and 1.00% by mass or less, and

Zr: 0.01% by mass or more and 0.20% by mass or less.

13. The component for a hot-dip metal plating bath according to claim 5, wherein the base material has a P content limited to 0.50% by mass or less.

14. The component for a hot-dip metal plating bath according to claim 5, wherein the thermal spray coating is formed of the cermet coating and the ceramic coating, and is formed by stacking the cermet coating and the ceramic coating in this order from a base-material side.

15. The component for a hot-dip metal plating bath according to claim 5, wherein the thermal spray coating includes the cermet coating, and the cermet coating contains (i) at least either one element of W and Mo, (ii) at least either one element of C and B, (iii) at least any one element of Co, Ni, and Cr, and (iv) element of Al.

* * * * *